US007461835B2

(12) United States Patent
Petz et al.

(10) Patent No.: US 7,461,835 B2
(45) Date of Patent: Dec. 9, 2008

(54) HUMIDIFIER

(75) Inventors: Gunter Petz, Nürnberg (DE); Rolf Petz, Nürnberg (DE)

(73) Assignee: Petz Industries GmbH & Co. KG, Teuschnitz (DE)

( * ) Notice: Subject to any disclaimer, the term of this patent is extended or adjusted under 35 U.S.C. 154(b) by 0 days.

(21) Appl. No.: 10/502,094

(22) PCT Filed: Jan. 24, 2002

(86) PCT No.: PCT/EP02/00676

§ 371 (c)(1),
(2), (4) Date: Jul. 22, 2004

(87) PCT Pub. No.: WO03/062711

PCT Pub. Date: Jul. 31, 2003

(65) Prior Publication Data

US 2005/0087071 A1 Apr. 28, 2005

(51) Int. Cl.
*B01F 3/04* (2006.01)

(52) U.S. Cl. ..... 261/119.1; 96/52; 96/63; 96/223; 96/329; 96/332; 96/337; 96/348; 96/364; 96/370; 96/371; 261/92; 261/DIG. 88

(58) Field of Classification Search ..... 96/52, 96/55, 57, 58, 63, 329, 332, 337, 348, 355, 96/361, 364, 370, 371, 223; 95/64, 69–71, 95/214, 218, 226; 55/493; 261/91, 92, 119.1, 261/DIG. 88

See application file for complete search history.

(56) References Cited

U.S. PATENT DOCUMENTS 1,838,512 A * 12/1931 Wilson ..... 95/214
1,918,531 A * 7/1933 Gentry ..... 96/276
2,079,574 A * 5/1937 Lea ..... 261/91
2,102,353 A * 12/1937 Brock ..... 96/334
2,119,207 A * 5/1938 Gibbs ..... 261/81
2,201,650 A * 5/1940 Hallerberg ..... 96/339
3,229,450 A * 1/1966 Stern ..... 96/258
3,348,821 A * 10/1967 Martin et al. ..... 261/29
3,552,097 A * 1/1971 Grasseler ..... 96/282
4,452,615 A * 6/1984 Schlachet ..... 96/248
4,640,696 A * 2/1987 Hicks et al. ..... 96/248
4,676,811 A * 6/1987 Wade ..... 96/262
5,076,972 A * 12/1991 Lu ..... 261/24
5,180,406 A * 1/1993 Shih ..... 96/262
5,433,772 A * 7/1995 Sikora ..... 96/87
5,669,946 A * 9/1997 Blair, Jr. ..... 96/291
5,702,507 A * 12/1997 Wang ..... 96/55
5,904,896 A * 5/1999 High ..... 422/4
6,354,936 B1 * 3/2002 Noh et al. ..... 454/201

* cited by examiner

*Primary Examiner*—Richard L Chiesa
(74) *Attorney, Agent, or Firm*—Kubotera & Associates, LLC

(57) ABSTRACT

An air humidifier has an electric fan unit arranged in a housing for delivering a through-flow of air between feed-air and discharge-air openings in the housing; at least one filter device for the through-flow of air; and a device for releasing liquid to the through-flow of air. A first housing component accommodates the fan unit with filter strips and feed-air and discharge-air openings. A second housing component is a vessel for storing liquid. The two housing components form autonomous structural units which can be fixed to and detached from one another. It is possible for the first housing component to be utilized as a separate unit independently of the second housing component.

29 Claims, 3 Drawing Sheets

HUMIDIFIER

The invention relates to an air humidifier having an electric fan unit arranged in a housing for delivering a through-flow of air between feed-air and discharge-air openings in the housing, a filter device for the through-flow of air and a device for releasing liquid to the through-flow of air.

In air humidifiers, liquid droplets are taken up and discharged by a through-flow of air generated in the housing of the air humidifier being guided past bodies which release liquid, for example made from textile or sponge materials or the like. The range of applications for the known air humidifiers are limited, since they do not permit use as aerating and/or ventilation equipment without release of liquid.

It is an object of the invention to provide an air humidifier which can optionally be used with or without humidification of the through-flow of air.

According to the invention, this object is achieved by the measures of the characterizing clause of claim 1.

Dividing the housing of the air humidifier in two enables the individual housing components optionally to be used together or independently of one another, with the result that the first housing component can be used, for example, as a pure ventilation unit, thereby reducing its weight, whereas the combination of the two housing components, in addition to ventilation, also allows airborne liquid droplets to be released, i.e. can be used for air humidification and cooling.

According to a preferred embodiment of the air humidifier, the two housing components are of substantially box-like design and, once placed or fitted freely onto, above or into one another, can be fixedly but releasably connected to one another by clamping members, e.g. screw-connection or plug-connection elements, clips or the like. The box-like design of the housing components contributes to the stability and mobility of the air humidifier. It is preferable for the second housing component to be designed at least approximately the same as the cross-sectional shape and cross-sectional size of the first housing component, so that it is in tub-like or pot-like configuration. The tub-like formation of the second housing component allows a relatively large quantity of liquid, e.g. water, to be stored, so that it is possible to achieve prolonged periods of use without the liquid having to be topped up.

It will be understood that the first housing component can be operated with a single fan unit. However, it is particularly advantageous to provide a double fan unit for the purpose of increasing the surface area of the through-flow of air combined, at the same time, with a reduction in its noise level.

It is expedient for the first housing component of the air humidifier to be provided with at least one first filter stage for the feed air and at least one further filter stage for the discharge air of the through-flow of air. In this context, the first filter stage, as seen in the direction of the through-flow of air, and if appropriate also the second filter stage may be configured as particle filters. A preferred embodiment of the air humidifier results if the first filter stage is configured as a feed-air filter door which engages over a housing opening for the feed air by means of hinge joints or by being plug-connected on. In this way, the filter element is accessible quickly and without difficulty, for example for cleaning purposes. There is also provision for the second filter stage to be designed as a discharge-air filter door. Finally, the filter stages may each have an added bacteria filter, which has a beneficial effect on the well-being of the user and his health when the air humidifier is in use. It is also possible to use additional chemical sterilization devices instead of the bacteria filters.

Furthermore, in one refinement of the air humidifier, there is provision for an ionization and ozonization assembly, which operates in accordance with the dielectric barrier discharge principle, to be assigned to the through-flow of air in the first housing component, and, in addition to a feed-air filter, for a sorption catalyst unit to be formed as discharge-air filter, serving the purpose of eliminating the ozone constituents which are present in the through-flow of air. The ionization and ozonization assembly may expediently be disconnected from the power supply via a switching member, so that the air humidifier can optionally be used with its first housing component as a ventilation unit with or without ozone treatment of the through-flow of air and also, in combination with the second housing compartment, for humidification of air. The ionization and ozonization assembly may preferably be formed by a flat module or by a Siemens ionization tube. The ozone fraction in the through-flow of air advantageously has a sterilizing and odor-neutralizing action on odiferous particles in gases or vapors, such as malodorous substances, and on the liquid provided for the humidification.

In a further refinement of the air humidifier, at least one device for releasing perfumes, aromas or the like is assigned to the through-flow of air in the first housing component. If a plurality of release devices of this nature are provided, the perfumes, aromas or the like can optionally be activated separately on an individual basis or in combination with one another as a mixture to form combinations of perfumes. The perfumes or aromas improve the room air and have beneficial effects on the user's psyche. The release devices may preferably be formed by one or more vessels, in particular in tube or cup form, with a storage medium, e.g. silica gel, accommodated therein with the ability to store the perfumes and to discharge them, for example continuously or periodically, preferably via the through-flow of air. It will be understood that it is also possible for other suitable materials, such as aluminum oxide, to be used as storage medium for the perfumes or aromas. The device for releasing perfumes, aromas or the like may be connected upstream and/or downstream of the sorption catalyst device, as desired.

Furthermore, there is provision for the first housing component to be equipped on the base side with passage openings, which can be controlled by pivotable flaps or the like, for a branched-off part of the through-flow of air which can be guided into and out of the second housing component. The branched-off part of the air which can be guided over the liquid in this way serves to take up liquid particles and to humidify the through-flow of air, and also to improve the effect of the sorption catalyst. The pivotable actuation of the flaps may be effected either manually or automatically as desired, for example by means of attachments, pins or the like which are fixed to the second housing component and run onto the flaps when the two housing components are being connected, to perform an automatic opening operation.

A more or less intensive transfer of liquid to the branched-off part of the air can be achieved by assigning evaporation bodies to the liquid, which bodies can be wetted by virtue of part of their length being immersed in the liquid, while the remaining part of the bodies projects into the branched-off part of the through-flow of air. The evaporation bodies allow the transfer of liquid to be made variable and/or adjustable by means of hygroscopy. Advantageous evaporation bodies may be formed by floating bodies, in particular spherical in form and made from a plastic, e.g. polyethylene, or woven fabrics, folded sections of paper strips, disk bodies or the like supported by floating bodies.

In a refinement of the air humidifier, the second housing component may be provided with a filling or refilling opening for the liquid, which can be controlled by a pivotable or slideable closure member and which is preferably arranged in a side wall of the second housing component. However, the second housing component can be made particularly easy to fill with liquid if a partial length and/or partial width of the second housing component projects transversely outward beyond a side wall of the first housing component, in which case, to avoid unintentional discharge of liquid, the projecting partial length or partial width can be closed off by a pivotable, slideable or plug-connection component.

In a further refinement of the air humidifier, there is provision for the second housing component to be configured on the inner side with a removable flexible film or foil or the like, in order in this way to allow any contaminating deposits from the liquid to be removed quickly and easily by pulling out and cleaning the film or foil or by introducing a replacement film or foil. To keep the liquid free of germs, applied foils comprising copper-containing materials, e.g. in a plastic support, have proven advantageous. The copper materials have proven effective at combating the growth of bacteria in the liquid. The same effect can be achieved by introducing or laying bodies in strip or plate form and made from copper or copper alloy into or on the film or foil.

Finally, an alternative refinement of the air humidifier is provided by the combination of a first, substantially box-like housing component with a second, pot-like housing component as liquid-release device, which has a permanently open side wall, preferably the top side, via which the first housing component can be inserted into the second housing component from above, it being possible for passage openings, which are formed in the base side in the first housing component, for a partial quantity of the through-flow of air to pass through, to be automatically moved into an open position and to be automatically closed when the first housing component is pulled out. The plug-insertion operation can be delimited by attachments or widened portions of the first housing component running onto protuberances or the edge of the second housing component. The air humidifier formed in this way gives the impression of being a single-piece appliance and can be transported safely, easily and in a space-saving manner. The passage openings can preferably be controlled by means of pivotable or slideable closure elements, such as flaps, which can be actuated under the influence of the plug-connection force of run-on bodies arranged in a fixed position in the second housing component, e.g. pins, strip parts or the like, during the plug-connection movement of the first housing component. It will be understood that, in the case of air humidifiers with housing components which can be fitted into one another, the feed-air and discharge-air openings for the through-flow of air have to lie adjacent to and at a distance from one another in a freely accessible wall of the first housing component, e.g. in the top side.

The invention is explained on the basis of exemplary embodiments. In the drawing.

Figure 2:
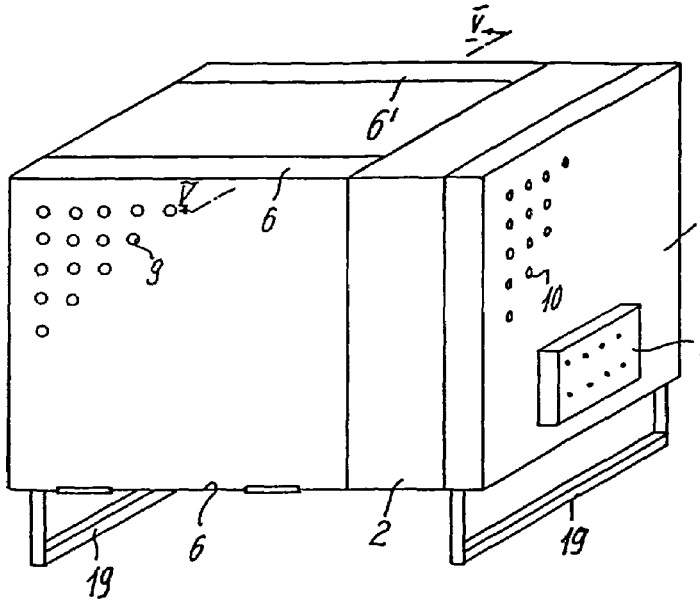
FIG. 2 shows a perspective view of a first housing component.
Figure 1:
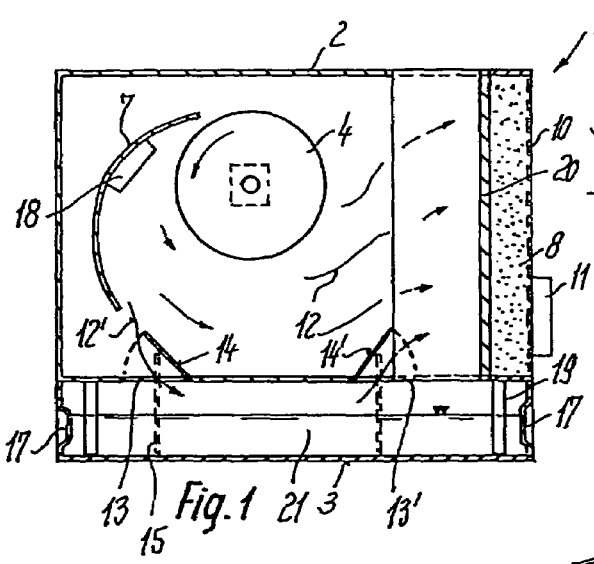
FIG. 1 shows a side view, partially in section, of an air humidifier.
Figure 5:
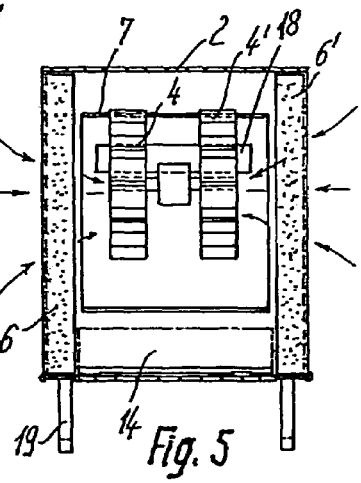
Figure 10:
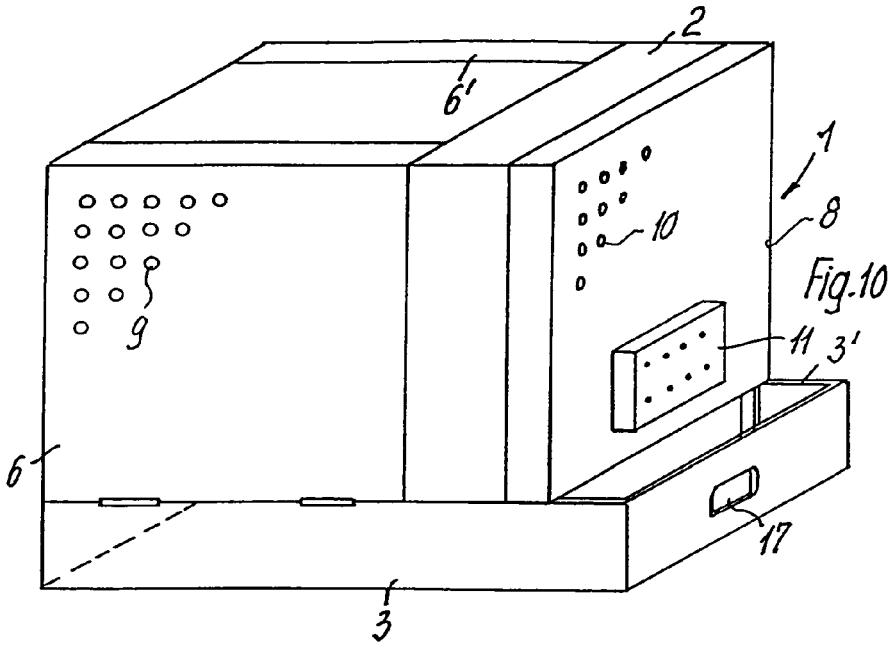
Figure 6:
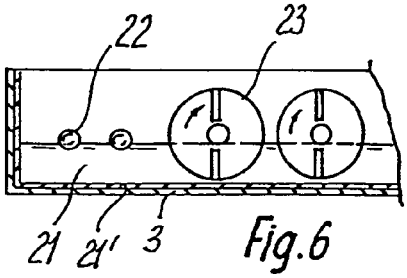
Figure 7:
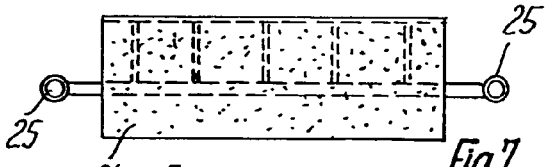
Figure 9:
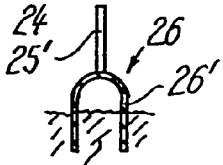
Figure 8:
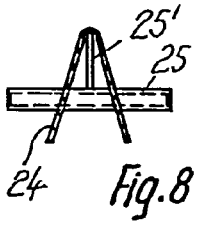
Figure 11:
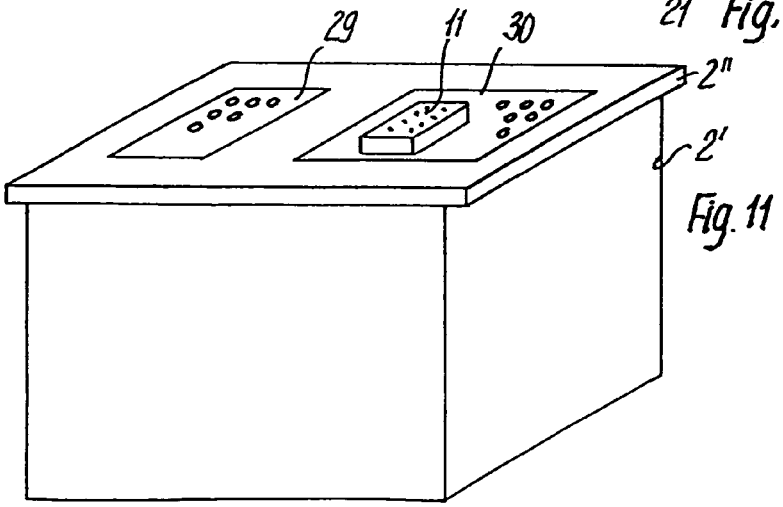
Figure 13:
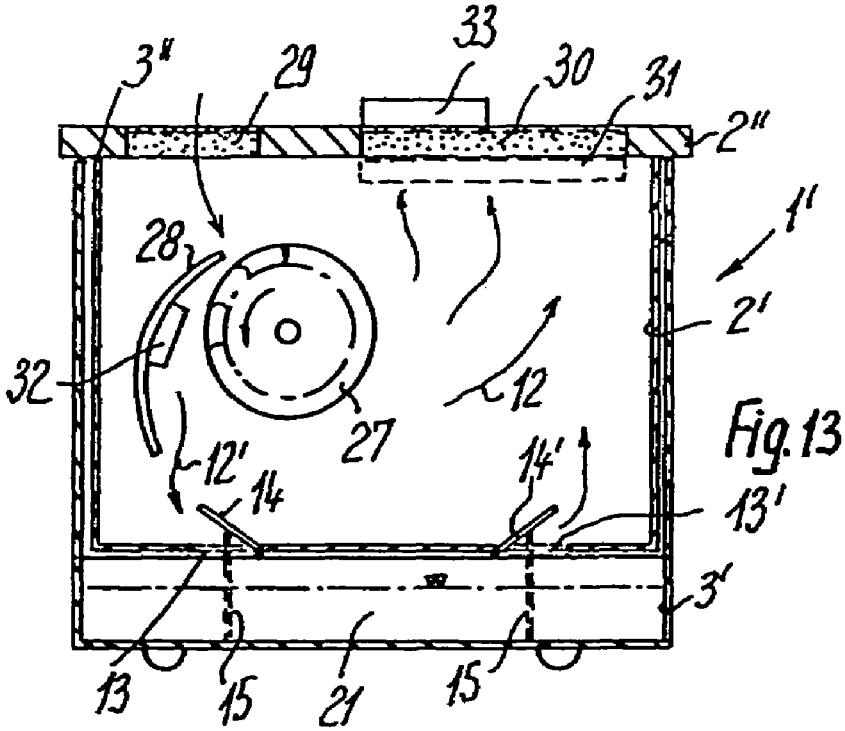
Figure 12:
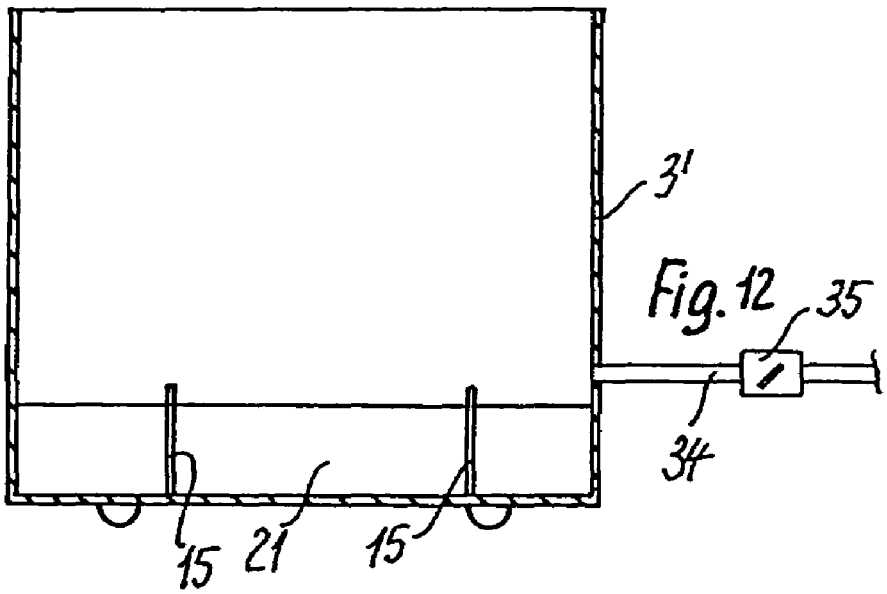

FIG. 5 shows a first housing component as shown in FIG. 1 in section on line V-V from FIG. 2, FIG. 6 shows a partial section through a second housing component, FIG. 7 shows a side view of one embodiment of an evaporation body support, FIG. 8 shows a section on line VIII-VIII from FIG. 7, FIG. 9 shows a front view of another refinement of an evaporation body support, FIG. 10 shows a perspective view of an air humidifier with an extended second housing component, FIG. 11 shows a perspective view of a first housing component of another air humidifier, FIG. 12 shows a sectional view through a second housing component, and FIG. 13 shows a sectional view through an air humidifier as shown in FIGS. 11 and 12.

Figure 3:
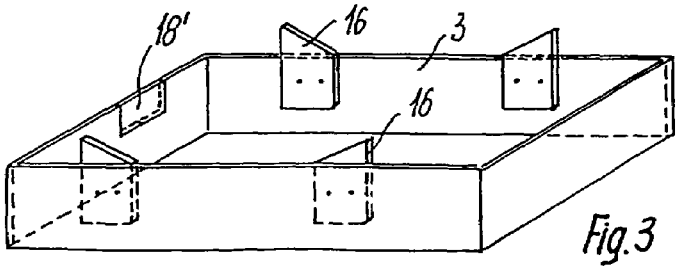
FIG. 3 shows a perspective view of a second housing component.

In FIGS. 1 to 3, 1 denotes an air humidifier, which is formed by a first housing component 2 and a second housing component 3. The two housing components 2, 3 can be stacked freely on top of one another as independent structural elements, substantially box-like in form, or, once they have been stacked, can be fixedly but releasably connected to one another. As can be seen in particular from FIG. 4, the housing component 2 has an electric fan unit 4 and a feed-air opening 5, which can be controlled by an air filter door 6 for feed air. In the exemplary embodiment, a metal guide plate 7 for guiding the fan air is assigned to the fan unit 4. The air filter door 6 forms a housing wall of the housing component 2 and has a multiplicity of holes 9 for the feed air to pass through over its entire surface. A discharge-air filter, which forms a further housing wall and is provided with holes 10 for the air to pass through, is denoted by 8. The housing component 2, when used as a stand-alone unit, is suitable for use as an appliance for ventilating rooms or the like.

A device for releasing perfumes, aromas or the like is denoted by 11, is preferably designed as a perfume battery and provides the option of releasing perfumes, aromas or the like stored by means of storage media, e.g. silica gel, in the release device 11 to the room air either continuously or periodically by means of, for example, part of the through-flow of air 12.

As an alternative option, the housing component 2 shown in FIG. 5 is fitted with two fan units 4 and 4' and is provided with two associated air filter doors 6, 6'. The fan units 4, 4' generate a through-flow of air forming a large surface area and only require a reduced rotational speed, with a reduced noise level, to achieve the same delivery of air. A metal air-guide plate 7 in turn serves to guide and direct the fan air. Furthermore, in the region of its base surface, the housing component 2 is provided with passage openings 13, 13' for a branched-off part 12' of the through-flow of air 12. The air part 12' passes via the passage opening 13 into the housing component 3, where it can be guided over the level of the liquid 21 and, having been enriched with liquid particles, can then be returned via the passage opening 13' into the housing component 2, in the direction of the discharge-air filter 8. The passage openings 13, 13' are assigned pivotable flaps 14, 14', which serve as closure members for the passage openings 13, 13' and can be moved into the open positions either manually or automatically through the provision of pins 15 or flat parts 16 in or on the housing component 3 when the housing component 2 is being fitted onto the housing component 3 as a result of the flaps running onto the pins 15 or flat parts 16. When the housing component 2 is removed and the run-on force is no longer present, the flaps 14, 14' automatically pivot back into the closed position for the housing component 2, preferably under the force of gravity.

As shown in FIG. 3, the housing component 3 is tub-like in form and serves to receive and store a relatively large quantity of liquid 21. To facilitate handling of the housing component 3, handles 17 are provided in opposite side walls thereof. Furthermore, the housing component 3 is equipped with a preferably closeable filling opening 18 for liquid 21. FIG. 10 shows a particularly simple filling opening for the liquid 21. For this purpose, a partial length 3' of the housing component 3 shown in that figure projects beyond the housing component 2.

Whereas in FIG. 2, the first housing component 2 is used as a ventilation unit, in FIG. 1 the two housing components 1 and 2 together form the air humidifier 1. Under the influence of the sucking action of the fan units 4 or 4 and 4', feed air passes via the air filter doors 6 or 6 and 6' into the housing component 2 and then passes into the room via the discharge-air filter 8. At the same time, the partial air quantity 12' can pass through the housing component 3, via the passage openings 13, 13', in order to be enriched with liquid, and leave the housing component 2 as a humidified air flow together with the through-flow of air 12. It is expedient for the housing component 2 to be provided with foot bars 19, enabling the housing component 2 to be set up at a distance above standing surfaces.

The housing component 2 is equipped with an ionization or ozonization assembly 18, which serves to generate and release ozone to the through-flow of air 12. Harmful air constituents in gas and/or vapor form, as well as bacteria, microbes or the like, which may be present in the through-flow of air 12 can be eliminated by means of the ozone. To prevent an undesirable release of ozone into the room, the discharge-air filter 8 is formed by an activated carbon filter. In the exemplary embodiment shown in FIG. 1, the ionization and ozonization assembly 18 is designed as a flat module. Other forms of ozone generation, for example by means of a Siemens ionization tube, are also conceivable. The ionization and ozonization assembly 18 may be assigned an on/off switch, with the result that the housing component 2, when used as a stand-alone unit, can be used as a ventilation and filter unit, with or without ozone generation as desired, or if it is used in combination with the housing component 3 can be used as an air humidifier with or without generation of ozone.

A bacteria filter 20 or the like or a chemically acting sterilization device (not shown) is assigned to the feed-air filter 6 and/or discharge-air filter 8 for the purpose of sterilizing the through-flow of air 12.

Figure 4:
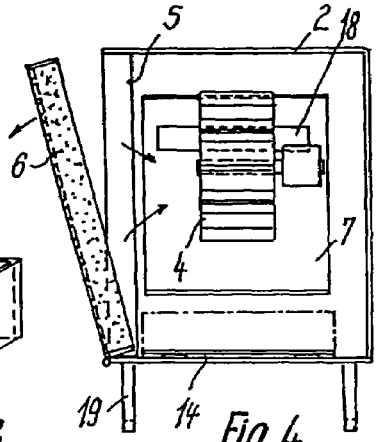
FIG. 4 shows a sectional view through a first housing component.

In accordance with FIG. 4, the housing component 3 is designed with a film or foil which serves to remove deposits of contaminating material which collect in the liquid 21. The housing component 3 can be cleaned quickly and easily by removing the film or foil 21. It is preferable for the foil 21 to contain copper or to be designed as a carrier for inlay bodies made from copper or copper-containing materials in order to additionally destroy germs.

For intensive wetting of the through-flow of air 12, the liquid 21 is assigned, as shown in FIG. 6, floating bodies 22 in spherical form serving as evaporation bodies or rotationally moveable disk bodies 23 with hygroscopic properties, which take up liquid particles by virtue of partial sections being immersed in the liquid 21 and, during rotary motion, release these liquid particles to the partial air quantity 12' as a result of the latter flowing onto them.

FIGS. 7 and 8 show an evaporation body which is formed by a folded paper strip 24 and is supported by cylindrical floating bodies 25. FIG. 9 shows a modified floating body 26, which is substantially U-shaped in form with continuous end sides, while its limbs 26' are immersed in the liquid 21. The evaporation body 24 is supported by means of webs 25', which are each fixed, either directly or indirectly, to the floating bodies 25, 26.

FIGS. 11 to 13 show a modified embodiment of an air humidifier 1'. A housing component 2' (FIG. 11) and housing component 3' (FIG. 12) are used in the air humidifier 1'. It is preferable for the housing component 3' to be of pot-like configuration and to be provided for the purpose of storing liquid 21. The top side of the housing component 3' is open, and the housing component 2' can be fitted into the housing component 3' via the open side, it being possible to limit the insertion operation by the widened edge strip 2" of the housing component 2' being supported on the edge 3" of the housing component 3'.

The housing component 2' has a fan unit 27 with an associated metal air-guide plate 28, serving to generate and guide a through-flow of air 12 in the housing component 2'. Furthermore, air passage openings 13, 13' are provided in the base region of the housing component 2' and are assigned base flaps 14, 14' as closure members. The base flaps 14, 14', if the housing component 2' is used separately, are held in the closed position by the force of gravity, whereas, when the housing component 2' is being plugged in for the purpose of the two housing components 2' and 3' being used together, the base flaps 14, 14' can automatically be pivoted into the open positions by pins 15 provided on the housing component 3' running onto the base flaps 14, 14'. Feed-air filter and discharge-air filter, which may each be assigned bacteria filters 31, are denoted by 29 and 30. Moreover, the air humidifier shown in FIGS. 11 to 13 is assigned an ionization and ozonization assembly 32 and also a device 33 for releasing perfumes, located in the region of the through-flow of air 12.

To facilitate handling of the air humidifier, in particular in stationary use, there is furthermore provision for a tube or hose line to be fitted to the second housing component 3' and for the second housing component 3' to be supplied with liquid periodically, either manually or continuously with automatic control, via the corresponding line.

The invention claimed is:

1. An air humidifier having an electric fan unit arranged in a housing for delivering a through-flow of air between feed-air and discharge-air openings in the housing, at least one filter device for the through-flow of air and a device for releasing liquid to the through-flow of air, characterized by a first housing component, which accommodates the fan unit with filter strips and feed-air and discharge-air openings, and by a second housing component as a vessel for storing liquid, the two housing components forming autonomous structural units which can be fixed to and detached from one another, and it being possible for the first housing component to be utilized as a separate unit independently of the second housing component, wherein the first housing component, on the base side, has passage openings, which are controlled by pivotable flaps, for a branched-off part of the through-flow of air which can be guided into and out of the second housing component.

2. The air humidifier as claimed in claim 1, wherein the two housing components are of substantially box-shaped design and are placed or fitted freely onto or above one another or can be fixedly but releasably connected to one another by clamping members including screw-connection or plug-connection elements, and clips.

3. The air humidifier as claimed in claim 1, characterized in that the second housing component (3), having the cross-sectional shape and cross-sectional size of the first housing component (2), is designed in tub or pot form, engaging under the first housing component (2).

4. The air humidifier as claimed in claim 1, wherein the first housing component, in order to increase the surface area of the through-flow of air and to reduce the noise level, has a double fan unit.

5. The air humidifier as claimed in claim 1, wherein the first housing component has at least one first filter stage for the feed air and at least one second filter stage for the discharge air of the through-flow of air.

6. The air humidifier as claimed in claim 5, wherein the first and/or second filter stage, as seen in the direction of the through-flow of air, are configured as particle filters.

7. The air humidifier as claimed in claim 5, wherein the first filter stage is designed as a feed-air filter door which is held on the first housing component by means of hinge joints or by means of a plug connection and which covers the housing opening for the feed air of the through-flow of air.

8. The air humidifier as claimed in claim 5, wherein the second filter stage is designed as a discharge-air filter door and is held on the first housing component by means of hinge joints or by means of a plug connection.

9. The air humidifier as claimed in claim 5, wherein an additional bacteria filter or a chemical sterilization device is in each case assigned to the first and/or second filter stage in the first housing component.

10. The air humidifier as claimed in claim 1, wherein at least one ionization and ozonization assembly, which is assigned to the through-flow of air and operates in accordance with the dielectric barrier discharge principle, is arranged in the first housing component, and a sorption catalyst unit is provided as discharge-air filter for eliminating excess ozone present in the through-flow of air.

11. The air humidifier as claimed in claim 10, wherein the ionization and ozonization assembly is formed as a flat module or by a Siemens ionization tube.

12. The air humidifier as claimed in claim 10, wherein the sorption catalyst unit is formed by a carbon filter including an activated carbon filter.

13. The air humidifier as claimed in claim 1, wherein the first housing component has at least one device, assigned to the through-flow of air, for releasing perfumes or aromas, and in that, if a plurality of these release devices are provided, the perfumes or aromas can be activated separately on an individual basis or in combination with one another in order to form a combination of perfumes.

14. The air humidifier as claimed in claim 13, wherein the device for releasing perfumes or aromas is formed by one or more vessels, in tube or cup form, with a liquid or solid storage medium including silica gel or aluminum oxide, accommodated therein, and in that the perfumes or aromas are stored in the storage medium and can be discharged from the storage medium by an gaseous medium including the through-flow of air.

15. The air humidifier as claimed in claim 13, wherein the devices for releasing perfumes or aromas which are assigned to the through-flow of air are connected upstream and/or downstream of the sorption catalyst unit.

16. The air humidifier as claimed in claim 1, wherein the second housing component has a filling or refilling opening for liquid, which can be controlled by a flap formed by a pivotable or slideable closure member.

17. The air humidifier as claimed in claim 1, characterized in that the second housing component (3), in order to form a filling or refilling opening for liquid (21), projects transversely outward beyond a side wall of the first housing component (2) by means of a partial length (3') and/or a partial width.

18. The air humidifier as claimed in claim 17, characterized in that the partial length (3') and/or partial width of the second housing component (3) which serves as the filling or refilling opening can be closed off by a pivotable, slideable or plug-connection component.

19. The air humidifier as claimed in claim 1, wherein the transfer of liquid to the branched-off part of the through-flow of air in the second housing component can be increased and/or adjusted by means of at least one wettable evaporation body, a partial length of which is immersed in the liquid.

20. The air humidifier as claimed in claim 19, wherein the evaporation bodies are formed as floating bodies, spherical in form and made from a plastic or woven fabrics, folded components including paper strips, or disk bodies rotatably supported by floating bodies, a section of which is permanently immersed in the liquid, while the remaining section projects into the branched-off part of the through-flow of air.

21. The air humidifier as claimed in claim 1, wherein the second housing component is configured on the inner side with a removable film or foil made from a flexible material.

22. The air humidifier as claimed in claim 21, wherein the film or foil is formed from a copper-containing material or a material having characteristics of a copper-containing material.

23. The air humidifier as claimed in claim 21, wherein the film or foil, on the inner side, bears, in a fixed position or loosely, an inlay body in strip or plate form and made from copper or a copper alloy.

24. The air humidifier as claimed in claim 1, having a first housing component with fan, filter, perfuming, ionization and ozonization devices accommodated therein, characterized by a first, substantially box-shaped housing component and a second, potshaped housing component as a liquid storage device with an open side, via which the first housing component can be inserted into the second housing component, it being possible for passage openings for a branched-off partial quantity of the through-flow of air, which are closed off on the base side in the first housing component—to be automatically moved into an open position in the inserted state, and for the passage openings to be automatically closed when the first housing component is pulled out of the second housing component.

25. The air humidifier as claimed in claim 24, wherein the passage openings can be controlled by means of pivotable or slideable closure elements which can be moved into the open position by means of run-on bodies arranged in a fixed position in the second housing component including pins and strip parts, as a result of the weight or plug-connection force that can be applied by the first housing component during the plug-connection movement of the first housing part.

26. The air humidifier as claimed in claim 24, wherein the feed-air and dischargeair openings for the through-flow of air are formed in the top side of the first housing component, adjacent to and at a distance from one another.

27. The air humidifier as claimed in claim 1, wherein the second housing component bears against a tube or hose line, and in that the second housing component can be periodically filled or refilled with liquid, either manually or with continuous automatic control, via the tube or hose line.

28. The air humidifier as claimed in claim 5, wherein the second filter stage for the discharge air is formed in a side wall and/or in the top side of the housing component.

29. An air humidifier comprising:

a housing including a first housing component having intake and exhaust openings, and a second housing component as a vessel for storing a liquid, the first and second housing components forming autonomous structural units that can be fixed to and detached from one another;

an electric fan unit in the housing and delivering a through-flow of air between the intake and discharge openings in the housing;

at least one filter device that filters the through-flow of air; and a device that releases liquid to the through-flow of air, wherein the first housing component is usable as a separate unit independently of the second housing component, and wherein the first housing component has passage openings on a base side, which are controlled by pivotable flaps, for a branched-off part of the through-flow of air which can be guided into and out of the second housing component.

* * * * *